US008334820B2

(12) United States Patent
Ryu et al.

(10) Patent No.: US 8,334,820 B2
(45) Date of Patent: Dec. 18, 2012

(54) PLASMA DISPLAY PANEL

(75) Inventors: Seongnam Ryu, Gumi (KR); Gibum Lee, Gumi (KR); Jongmun Yang, Gumi (KR); Jain Goo, Gumi (KR); Hyeonjae Lee, Gumi (KR); Jinyoung Kim, Gumi (KR); Jeonghyun Hahm, Gumi (KR); Myongsoon Jung, Gumi (KR); Jihoon Lee, Gumi (KR)

(73) Assignee: LG Electronics Inc., Seoul (KR)

( * ) Notice: Subject to any disclaimer, the term of this patent is extended or adjusted under 35 U.S.C. 154(b) by 1161 days.

(21) Appl. No.: 11/931,735

(22) Filed: Oct. 31, 2007

(65) Prior Publication Data

US 2009/0009433 A1 Jan. 8, 2009

(30) Foreign Application Priority Data

Jul. 4, 2007 (KR) ..... 10-2007-0067213

(51) Int. Cl.
*G09G 3/28* (2006.01)

(52) U.S. Cl. ..... 345/60; 345/66; 345/65; 345/204; 313/581; 313/582; 313/583; 313/584; 313/585; 313/586; 313/587; 315/169.4

(58) Field of Classification Search ..... 345/60, 345/65, 204, 66; 313/581–587; 315/169.4
See application file for complete search history.

(56) References Cited

U.S. PATENT DOCUMENTS

| | | | | |
|---|---|---|---|---|
| 4,081,712 | A * | 3/1978 | Bode et al. | 313/586 |
| 7,009,587 | B2 * | 3/2006 | Nishimura et al. | 345/67 |
| 2004/0032215 | A1 * | 2/2004 | Nishimura et al. | 315/169.3 |
| 2005/0029938 | A1 | 2/2005 | Kwon et al. | |
| 2005/0082976 | A1 * | 4/2005 | Chen et al. | 313/582 |
| 2006/0276322 | A1 * | 12/2006 | Hasegawa et al. | 501/49 |
| 2006/0290279 | A1 * | 12/2006 | Hur et al. | 313/582 |
| 2007/0052361 | A1 * | 3/2007 | Hasegawa et al. | 313/586 |
| 2007/0172672 | A1 * | 7/2007 | Miyazaki et al. | 428/432 |
| 2008/0150838 | A1 * | 6/2008 | Nagao et al. | 345/60 |

FOREIGN PATENT DOCUMENTS

| | | |
|---|---|---|
| CN | 1470064 | 1/2004 |
| CN | 1705044 | 12/2005 |
| JP | 2003-346660 | 12/2003 |
| JP | 2005-053770 | 3/2005 |
| JP | 2005-142073 | 6/2005 |
| KR | 10-2007-0039203 | 4/2007 |
| WO | WO 2006/038621 A1 * | 4/2006 |

OTHER PUBLICATIONS

Chinese Office Action dated Mar. 5, 2010.
International Search Report and Written Opinion dated Apr. 18, 2008.

* cited by examiner

*Primary Examiner* — Lun-Yi Lao
*Assistant Examiner* — Olga Merkoulova
(74) *Attorney, Agent, or Firm* — KED & Associates LLP

(57) ABSTRACT

A plasma display panel is disclosed. The plasma display panel includes a scan electrode and a sustain electrode positioned parallel to each other on a front substrate, an upper dielectric layer positioned on the scan electrode and the sustain electrode, a rear substrate on which an address electrode is positioned to intersect the scan electrode and the sustain electrode, a lower dielectric layer positioned on the address electrode, and a barrier rib positioned between the front substrate and the rear substrate. The barrier rib includes lead (Pb) equal to or less than 1,000 ppm (parts per million). A discharge gas is filled between the front substrate and the rear substrate and includes helium (He) of 9% to 42%.

19 Claims, 15 Drawing Sheets

FIG. 3

| | Barrier rib type | Ne(%) | Xe(%) | He(%) | Consumption power(W) | Efficiency (lm/W) | Luminance (cd/m$^2$) |
|---|---|---|---|---|---|---|---|
| Case 1 | A | 85 | 15 | 0 | 272 | 1.108 | 142 |
| Case 2 | A | 60 | 15 | 25 | 257 | 1.33 | 125 |
| Case 3 | A | 90 | 10 | 0 | 215.2 | 0.997 | 140 |
| Case 4 | A | 65 | 10 | 25 | 193 | 1.21 | 120 |
| Case 5 | B | 85 | 15 | 0 | 269 | 1.121 | 143 |
| Case 6 | B | 60 | 15 | 25 | 252 | 1.352 | 130 |
| Case 7 | B | 90 | 10 | 0 | 210.5 | 1.02 | 142 |
| Case 8 | B | 65 | 10 | 25 | 189.2 | 1.28 | 128 |

FIG. 4

| | Pb Content |
|---|---|
| Barrier rib | equal to or less than 1,000 ppm |
| Address electrode | equal to or less than 1,000 ppm |
| Lower dielectric layer | equal to or less than 1,000 ppm |
| Upper dielectric layer | equal to or less than 1,000 ppm |
| Scan electrode | equal to or less than 1,000 ppm |
| Sustain electrode | equal to or less than 1,000 ppm |
| Front substrate | equal to or less than 1,000 ppm |
| Rear substrate | equal to or less than 1,000 ppm |

FIG. 12

| d (μm) | Luminance | Firing voltage |
|---|---|---|
| 50 | X | ◎ |
| 70 | X | ◎ |
| 80 | ○ | ◎ |
| 90 | ○ | ◎ |
| 100 | ◎ | ◎ |
| 120 | ◎ | ◎ |
| 150 | ◎ | ◎ |
| 180 | ◎ | ◎ |
| 200 | ◎ | ◎ |
| 240 | ◎ | ○ |
| 250 | ◎ | ○ |
| 310 | ◎ | X |
| 350 | ◎ | X |

PLASMA DISPLAY PANEL

This application claims the benefit of Korean Patent Application No. 10-2007-0067213 filed on Jul. 4, 2007 which is hereby incorporated by reference.

BACKGROUND OF THE DISCLOSURE

1. Field of the Disclosure

This document relates to a plasma display panel.

2. Description of the Background Art

The plasma display panel includes a phosphor layer inside discharge cells partitioned by barrier ribs and a plurality of electrodes.

A driving signal is supplied to the electrodes, thereby generating a discharge inside the discharge cells. When the driving signal generates a discharge inside the discharge cells, a discharge gas filled inside the discharge cells generates vacuum ultraviolet rays, which thereby cause phosphors formed inside the discharge cells to emit light, thus displaying an image on the screen of the plasma display panel.

SUMMARY OF THE DISCLOSURE

In an aspect, a plasma display panel comprises a front substrate, a scan electrode and a sustain electrode that are positioned parallel to each other on the front substrate, an upper dielectric layer positioned on the scan electrode and the sustain electrode, a rear substrate on which an address electrode is positioned to intersect the scan electrode and the sustain electrode, a lower dielectric layer positioned on the address electrode, and a barrier rib that is positioned between the front substrate and the rear substrate and partitions a discharge cell, the barrier rib including lead (Pb) equal to or less than 1,000 ppm (parts per million), wherein a discharge gas is filled between the front substrate and the rear substrate and includes helium (He) of 9% to 42%.

In another aspect, a plasma display panel comprises a front substrate, a scan electrode and a sustain electrode that are positioned parallel to each other on the front substrate, the scan electrode and the sustain electrode each having a single-layered structure, an upper dielectric layer positioned on the scan electrode and the sustain electrode, a rear substrate on which an address electrode is positioned to intersect the scan electrode and the sustain electrode, a lower dielectric layer positioned on the address electrode, and a barrier rib that is positioned between the front substrate and the rear substrate and partitions a discharge cell, the barrier rib including lead (Pb) equal to or less than 1,000 ppm, wherein a discharge gas is filled between the front substrate and the rear substrate arid includes helium (He) of 9% to 42%.

In still another aspect, a plasma display panel comprises a front substrate, a scan electrode and a sustain electrode that are positioned parallel to each other on the front substrate, an interval between the scan electrode and the sustain electrode ranging from 80 μm to 250 μm, an upper dielectric layer positioned on the scan electrode and the sustain electrode, a rear substrate on which an address electrode is positioned to intersect the scan electrode and the sustain electrode, a lower dielectric layer positioned on the address electrode, and a barrier rib that is positioned between the front substrate and the rear substrate and partitions a discharge cell, the barrier rib including lead equal to or less than 1,000 ppm, wherein a discharge gas is filled between the front substrate and the rear substrate and includes helium (He) of 9% to 42%.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings:

FIG. 3 illustrates a characteristic of the plasma display panel including helium (He);

FIG. 4 illustrates a characteristic of the plasma display panel depending on a Pb content;

FIG. 12 is a graph showing a luminance and a firing voltage depending on an interval between a scan electrode and a sustain electrode.

DETAILED DESCRIPTION OF EMBODIMENTS

Reference will now be made in detail embodiments of the invention examples of which are illustrated in the accompanying drawings.

Figure 1A:
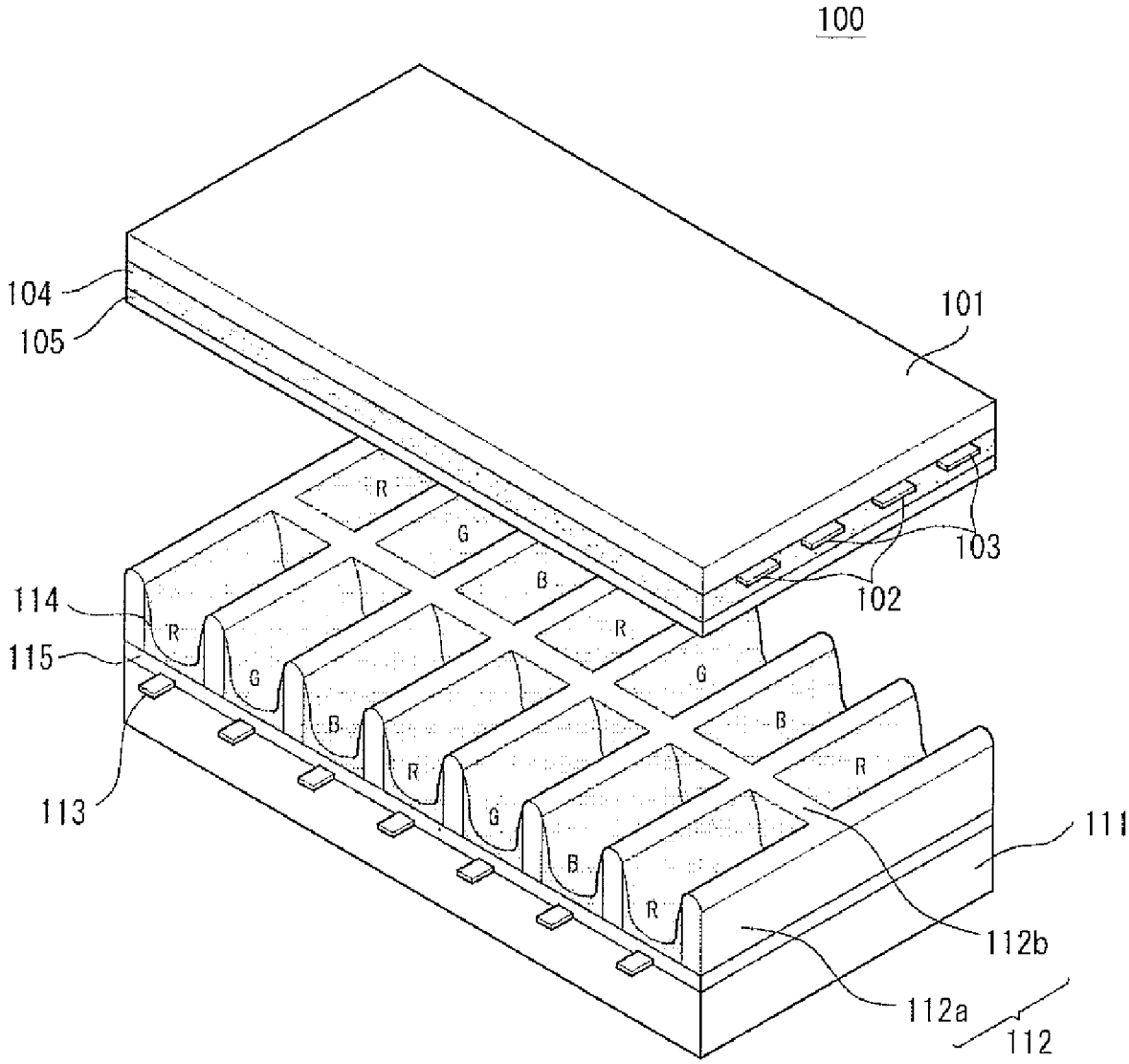
FIGS. 1A to 1C illustrate a structure of a plasma display panel according to an exemplary embodiment.
Figure 1B:
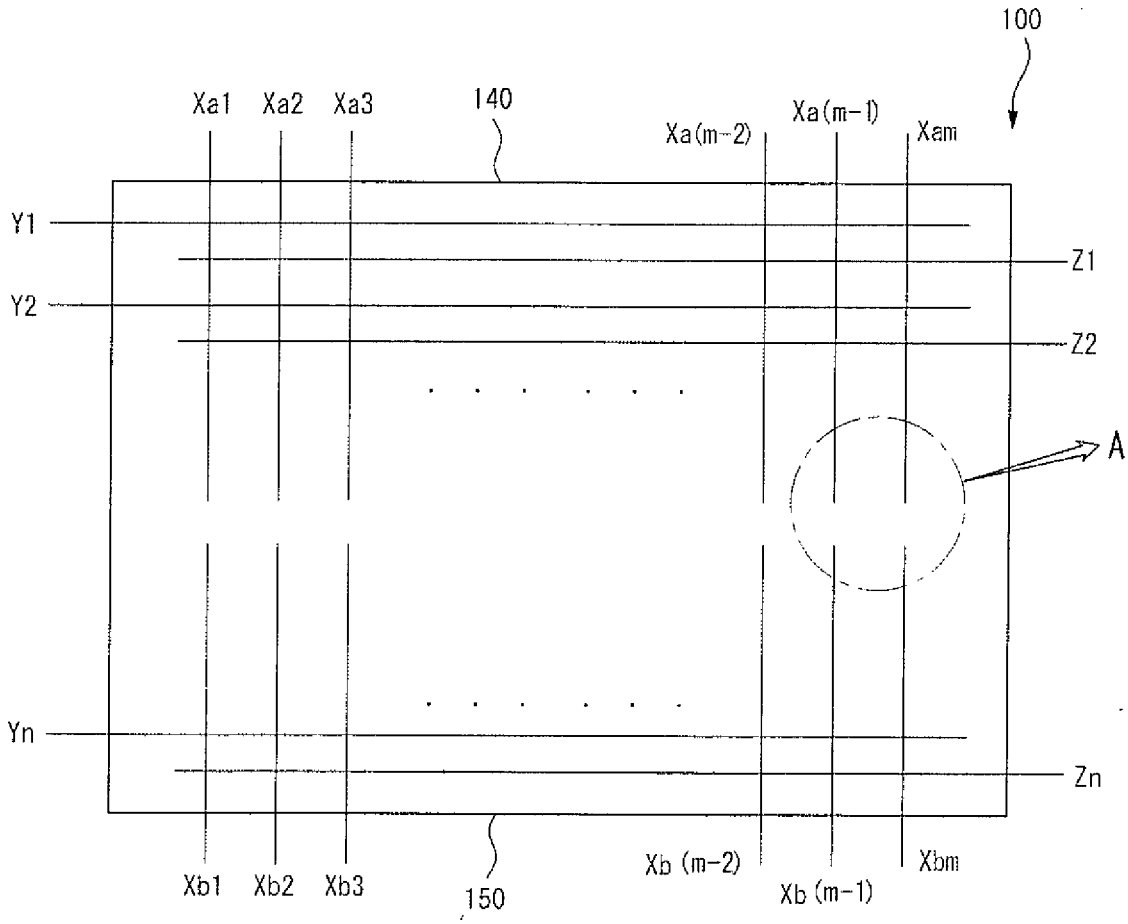
Figure 1C:
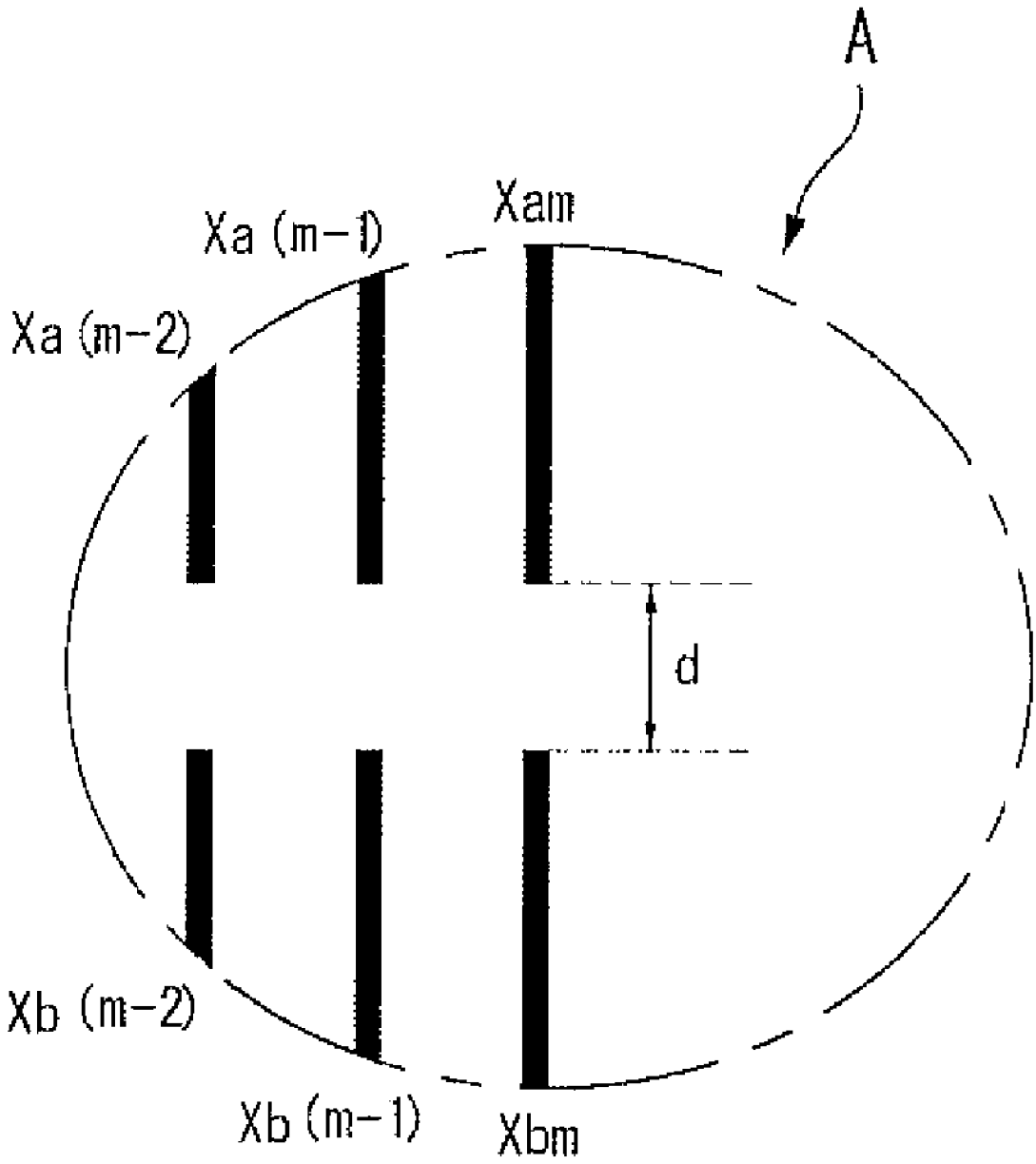

FIGS. 1A to 1C illustrate a structure of a plasma display panel according to an exemplary embodiment.

As illustrated in FIG. 1A, a plasma display panel 100 according to an exemplary embodiment includes a front substrate 101 and a rear substrate 111 which coalesce with each other using a seal layer (not shown) to be opposite to each other. On the front substrate 101, a scan electrode 102 and a sustain electrode 103 are positioned parallel to each other. On the rear substrate 111, an address electrode 113 is positioned to intersect the scan electrode 102 and the sustain electrode 103.

An upper dielectric layer 104 for covering the scan electrode 102 and the sustain electrode 103 is positioned on the front substrate 101 on which the scan electrode 102 and the sustain electrode 103 are positioned.

The upper dielectric layer 104 limits discharge currents of the scan electrode 102 and the sustain electrode 103, and provides electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 for covering the address electrode 113 is positioned on the rear substrate 111 on which the address electrode 113 is positioned. The lower dielectric layer 115 provides electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A red (R) discharge cell, a green (G) discharge cell, and a blue (B) discharge cell, and the like, may be positioned between the front substrate 101 and the rear substrate 111. In addition to the red (R), green (G), and blue (B) discharge cells, a white (W) discharge cell or a yellow (Y) discharge cell may be positioned.

Each discharge cell partitioned by the barrier ribs 112 is filled with a discharge gas.

A phosphor layer 114 is positioned inside the discharge cells to emit visible light for an image display during the generation of an address discharge. For instance, first, second and third phosphor layer respectively emitting red (R), green (G) and blue (B) light may be positioned inside the discharge cells. In addition to the red (R), green (G) and blue (B) light, a phosphor layer emitting white (W) or yellow (Y) light may be positioned.

A thickness of at least one of the phosphor layers 114 formed inside the red (R), green (G) and blue (B) discharge cells may be different from thicknesses of the other phosphor layers. For instance, thicknesses of the second and third phosphor layers inside the green (G) and blue (B) discharge cells may be larger than a thickness of the first phosphor layer inside the red (R) discharge cell. The thickness of the second phosphor layer may be substantially equal or different from the thickness of the third phosphor layer.

Widths of the red (R), green (G), and blue (B) discharge cells may be substantially equal to one another. Further, a width of at least one of the red (R), green (G), or blue (B) discharge cells may be different from widths of the other discharge cells. For instance, a width of the red (R) discharge cell may be the smallest, and widths of the green (G) and blue (B) discharge cells may be larger than the width of the red (R) discharge cell. The width of the green (G) discharge cell may be substantially equal or different from the width of the blue (B) discharge cell.

A width of the phosphor layer 114 positioned inside the discharge cell changes depending on the width of the discharge cell. For instance, a width of the second phosphor layer inside the green (G) discharge cell may be larger than a width of the first phosphor layer inside the red (R) discharge cell. Further, a width of the third phosphor layer inside the blue (B) discharge cell may be larger than the width of the first phosphor layer. Hence, a color temperature of an image displayed on the plasma display panel can be improved.

The plasma display panel 100 according the exemplary embodiment may have various forms of barrier rib structures as well as a structure of the barrier rib 112 illustrated in FIG. 1A. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, the height of the first barrier rib 112*b* may be smaller than the height of the second barrier rib 112*a*.

While FIG. 1A has been illustrated and described the case where the red (R), green (G) and blue (B) discharge cells are arranged on the same line, the red (R), green (G) and blue (B) discharge cells may be arranged in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1A has illustrated and described the case where the barrier rib 112 is formed on the rear substrate 111, the barrier rib 112 may be formed on at least one of the front substrate 101 or the rear substrate 111.

It should be noted that only one example of the plasma display panel according to the exemplary embodiment has been illustrated and described above, and the exemplary embodiment is not limited to the plasma display panel with the above-described structure. For instance, while the above description illustrates a case where the upper dielectric layer 104 and the lower dielectric layer 115 each have a sing-layered structure, at least one of the upper dielectric layer 104 or the lower dielectric layer 115 may have a multi-layered structure.

While the address electrode 113 positioned on the rear substrate 111 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

Referring to FIG. 1B, the plasma display panel 100 may be divided into a first area 140 and a second area 150.

In the first area 140, a plurality of first address electrodes Xa1, Xa1, . . . Xam are positioned parallel to one another. In the second area 150, a plurality of second address electrodes Xb1, Xb1, . . . Xbm are positioned parallel to one another to be opposite to the plurality of first address electrodes Xa1, Xa1, . . . , Xam.

FIG. 1C illustrates in detail an area A where the first address electrodes and the second address electrodes are opposite to each other.

Referring to FIG. 1C, the first address electrodes Xa(m-2), Xa(m-1) and Xam are opposite to the second address electrodes Xb(m-2), Xb(m-1) and Xbm with a distance d therebetween, respectively.

When the distance d between the first address electrode and the second address electrode is excessively small, it is likely that a current flows due to a coupling effect between the first address electrode and the second address electrode. On the other hand, when the distance d is excessively large, a user may watch a striped noise in an image displayed on the plasma display panel.

Considering this, the distance d may range from about 50 μm to 300 μm. Further, the distance d may range from about 70 μm to 220 μm.

Figure 2:
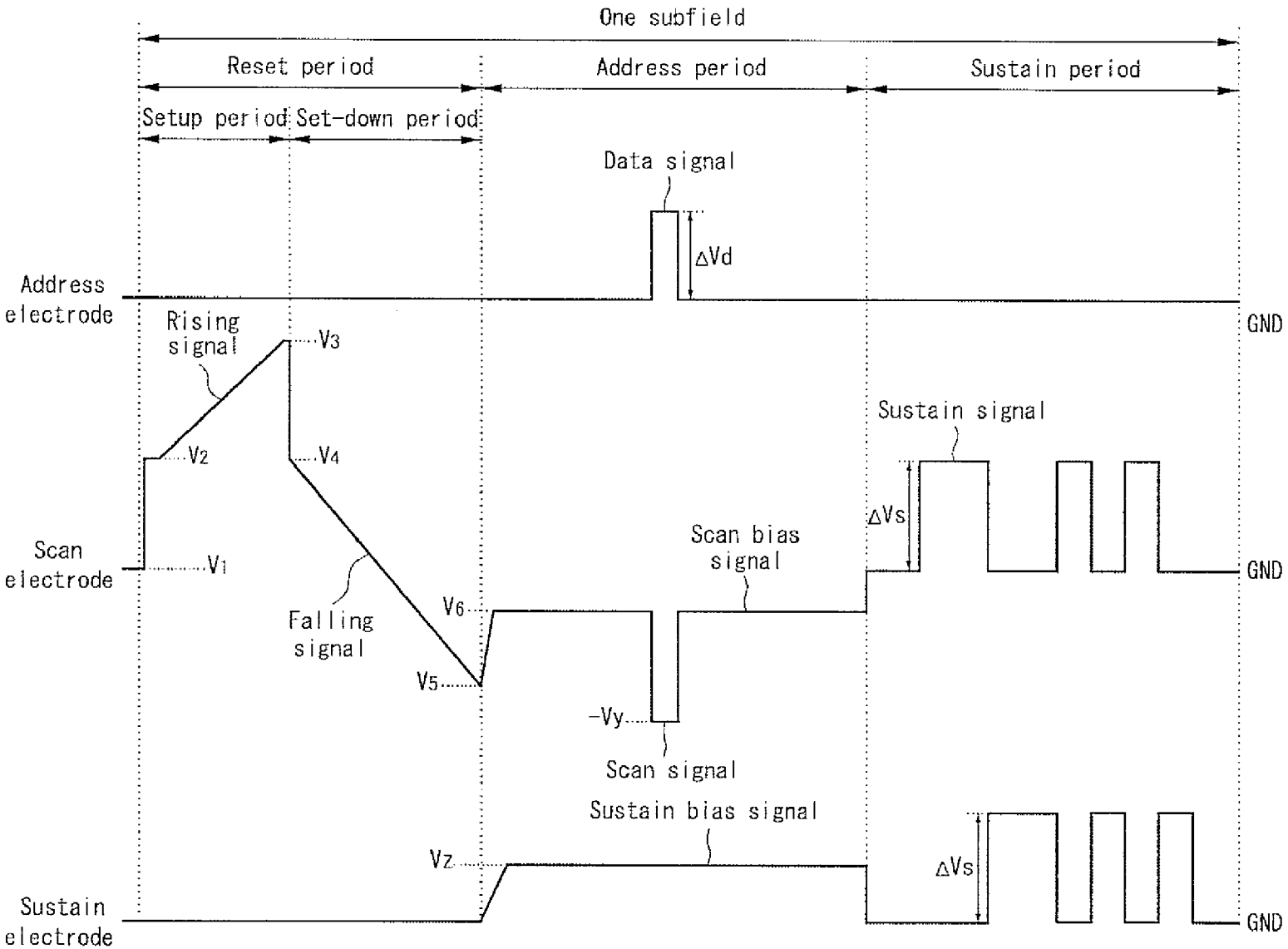
FIG. 2 illustrates an operation of the plasma display panel according to the exemplary embodiment.

FIG. 2 illustrates an operation of the plasma display panel according to the exemplary embodiment. The exemplary embodiment is not limited to FIG. 2, and an operation method of the plasma display can be variously changed.

As illustrated in FIG. 2, during a reset period for initialization of wall charges, a reset signal is supplied to the scan electrode. The reset signal includes a rising signal and a falling signal. The reset period is further divided into a setup period and a set-down period.

During the setup period, the rising signal is supplied to the scan electrode. The rising signal sharply rises from a first voltage V1 to a second voltage V2, and then gradually rises from the second voltage V2 to a third voltage V3. The first voltage V1 may be a ground level voltage GND.

The rising signal generates a weak dark discharge (i.e., a setup discharge) inside the discharge cell during the setup period, thereby accumulating a proper amount of wall charges inside the discharge cell.

During the set-down period, a falling signal of a polarity direction opposite a polarity direction of the rising signal is supplied to the scan electrode. The falling signal gradually falls from a fourth voltage V4 lower than a peak voltage (i.e., the third voltage V3) of the rising signal to a fifth voltage V5.

The falling signal generates a weak erase discharge (i.e., a set-down discharge) inside the discharge cell. Furthermore, the remaining wall charges are uniform inside the discharge cells to the extent that an address discharge can be stably performed.

During an address period which follows the reset period, a scan bias signal, which is maintained at a sixth voltage V6 higher than a lowest voltage (i.e., the fifth voltage V5) of the falling signal, is supplied to the scan electrode. A scan signal, which falls from the scan bias signal by a scan voltage magnitude ΔVy, is supplied to the scan electrode.

A width of a scan signal supplied during an address period of at least one subfield may be different from a width of a scan signal supplied during address periods of the other subfields. For instance, a width of a scan signal in a subfield may be larger than a width of a scan signal in the next subfield in time order. Further, a width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, . . . , 1.9 μs, 1.9 μs, etc.

As above, when the scan signal is supplied to the scan electrode, a data signal corresponding to the scan signal is supplied to the address electrode. The data signal rises from a ground level voltage GND by a data voltage magnitude ΔVd.

As the voltage difference between the scan signal and the data signal is added to the wall voltage generated during the reset period, the address discharge occurs within the discharge cell to which the data signal is supplied.

A sustain bias signal is supplied to the sustain electrode during the address period to prevent the generation of the unstable address discharge by interference of the sustain electrode Z.

The sustain bias signal is substantially maintained at a sustain bias voltage Vz. The sustain bias voltage Vz is lower than a voltage Vs of a sustain signal and is higher than the ground level voltage GND.

During a sustain period which follows the address period, a sustain signal is alternately supplied to the scan electrode and the sustain electrode. The sustain signal has a voltage magnitude corresponding to the sustain voltage Vs.

As the wall voltage within the discharge cell selected by performing the address discharge is added to the sustain voltage Vs of the sustain signal, every time the sustain signal is supplied, the sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can be more stable.

A discharge gas filled inside the plasma display panel includes helium (He). In addition to He, the discharge gas may further include xenon (Xe) and neon (Ne). Helium (He) can lower a firing voltage, thereby improving the driving efficiency.

FIG. 3 illustrates a characteristic of the plasma display panel including helium (He).

FIG. 3 illustrates a consumption power, an efficiency, and a luminance of a displayed image of each of a case 1 of the plasma display panel including Ne of 85% and Xe of 15% as a discharge gas, a case 2 of the plasma display panel including Ne of 60%, Xe of 15% and He of 25% as a discharge gas, a case 3 of the plasma display panel including Ne of 90% and Xe of 10% as a discharge gas, and a case 4 of the plasma display panel including Ne of 65%m Xe of 10% and He of 25% as a discharge gas.

A barrier rib in the cases 1 to 4 is formed of PbO—$B_2O_3$-$SiO_2$ glass. The barrier rib in the cases 1 to 4 includes lead (Pb) exceeding 1,000 ppm (parts per million), and is called an A-type barrier rib.

Further, FIG. 3 illustrates a consumption power, an efficiency, and a luminance of a displayed image of each of a case 5 having the same composition as the case 1, a case 6 having the same composition as the case 2, a case 7 having the same composition as the case 3, and a case 8 having the same composition as the case 4.

A barrier rib in the cases 5 to 8 includes Pb equal to or less than 1,000 ppm, and is called a B-type barrier rib.

As illustrated in FIG. 3, in the case 1, a consumption power is 272 W, an efficiency is 1.108 lm/W, and a luminance is 142 cd/$m^2$. In the case 2, a consumption power is 257 W, an efficiency is 1.33 lm/W, and a luminance is 125 cd/$m^2$. The case 2 including He of 25% has the lower consumption power and the higher efficiency compared with the case 1 not including He.

Further, in the case 3, a consumption power is 215.2 W, an efficiency is 0.997 lm/W, and a luminance is 140 cd/$m^2$. In the case 4, a consumption power is 193 W, an efficiency is 1.21 lm/W, and a luminance is 120 cd/$m^2$. The case 4 including He of 25% has the lower consumption power and the higher efficiency compared with the case 3 not including He.

In other words, helium (He) reduces the consumption power and increases the efficiency regardless of the content of Xe.

Because helium gas acts as a catalyst for a discharge generated inside the discharge cell, the discharge can occur at a relatively low voltage. Hence, in the plasma display panel including helium, the consumption power is reduced and the efficiency increases.

While helium improves the consumption power and the efficiency, helium reduces the luminance. For instance, the cases 2 and 4 including helium of 25% have the lower luminance compared with the cases 1 and 3 not including He.

A reduction in the luminance caused by helium can be prevented by setting a content of Pb in the barrier rib to be equal to or less than 1,000 ppm.

In the case 5, a consumption power is 269 W, an efficiency is 1.121 lm/W, and a luminance is 143 cd/$m^2$.

In the ease 6, a consumption power is 252 W, an efficiency is 1.352 lm/W, and a luminance is 130 cd/$m^2$.

In the case 7, a consumption power is 210.5 W, an efficiency is 1.02 lm/W, and a luminance is 142 cd/$m^2$.

In the case 8, a consumption power is 189.2 W, an efficiency is 1.28 lm/W, and a luminance is 128 cd/$m^2$.

The cases 5 to 8 including the B-type barrier rib have the higher efficiency and the higher luminance compared with the cases 1 to 4 including the A-type barrier rib. In other words, because the B-type barrier rib of the cases 5 to 8 includes a smaller amount of Pb than the A-type barrier rib of the cases 1 to 4, capacitance of the B-type barrier rib is less than capacitance of the A-type barrier rib. Hence, a discharge current decreases and an intensity of a discharge generated by an equal voltage level increases.

As above, when the Pb content of the barrier rib is equal to or less than 1,000 ppm, a reduction in a luminance of a displayed image can be prevented even if the discharge gas includes He.

To prevent the reduction in the luminance caused by helium of the discharge gas, at least one of the barrier rib, the address electrode or the lower dielectric layer may include Pb equal to or less than 1,000 ppm. In this case, a total content of Pb in the plasma display panel is equal to or less than 1,000 ppm.

FIG. 4 illustrates a characteristic of the plasma display panel depending on a Pb content.

As illustrated in FIG. 4, at least one of the barrier rib, the address electrode or the lower dielectric layer may include Pb equal to or less than 1,000 ppm. Hence, capacitance of the panel can be further reduced. Further, the reduction in the luminance caused by helium of the discharge gas can be prevented.

In addition to the barrier rib, the address electrode and the lower dielectric layer, at least one of the upper dielectric layer, the scan electrode, the sustain electrode, the front substrate or the rear substrate may include Pb equal to or less than 1,000 ppm. In this case, a total content of Pb in the plasma display panel is equal to or less than 1,000 ppm.

If Pb is accumulated inside the human body, Pb is a toxic material capable of adversely affecting the human body. Accordingly, when the barrier rib includes Pb equal to or less than 1,000 ppm in the plasma display panel according to the exemplary embodiment, an influence of Pb on the human body can be reduced.

Figure 5A:
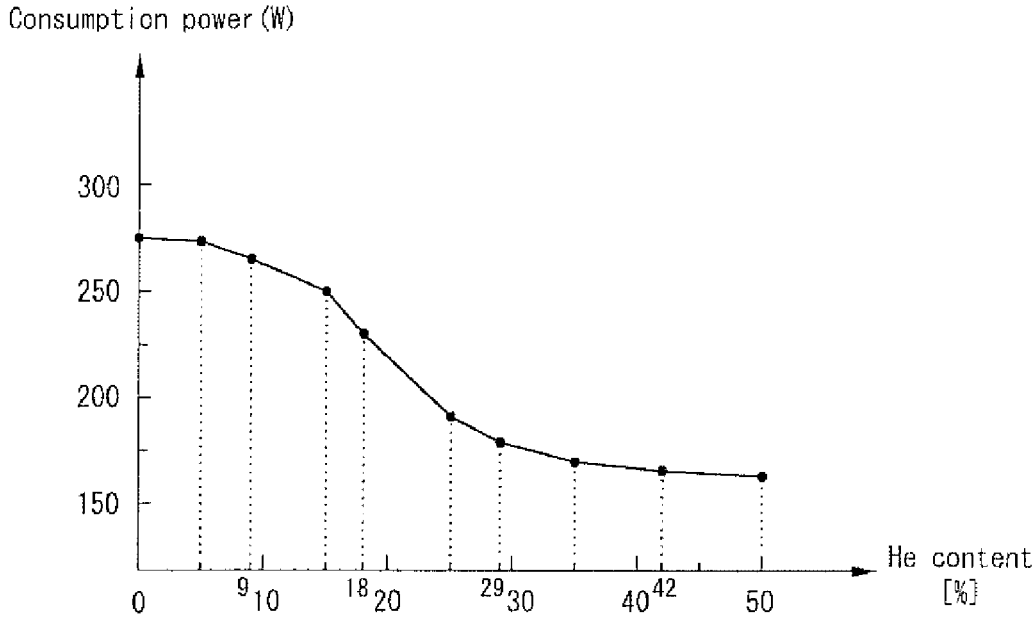
FIGS. 5A and 5B are graphs showing a consumption power and a luminance depending on a content of helium (He)
Figure 5B:
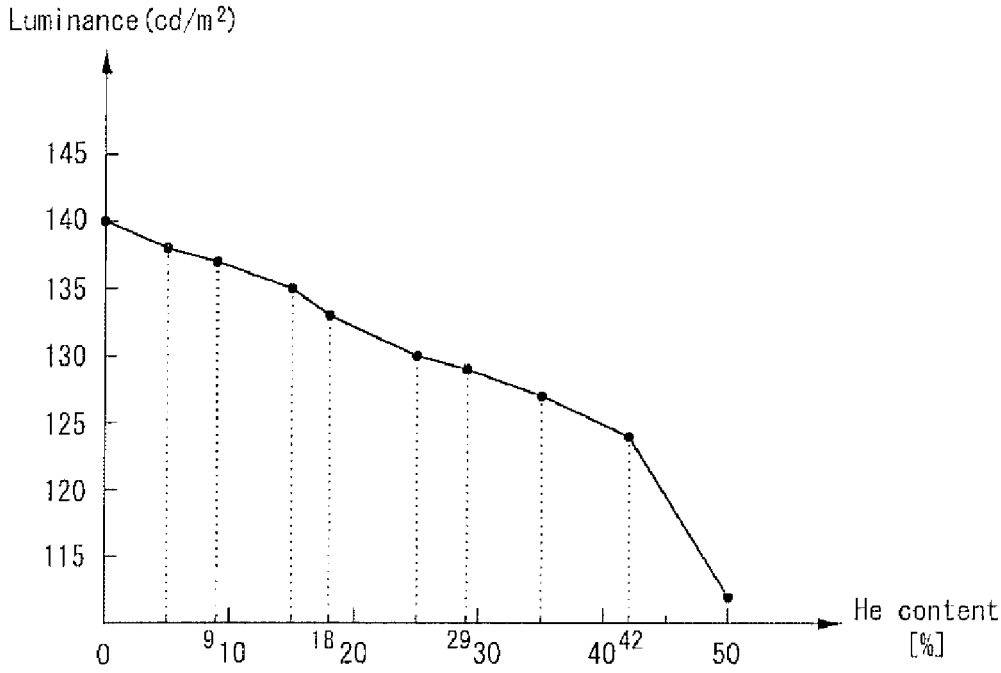

FIGS. 5A and 5B are graphs showing a consumption power and a luminance depending on a content of helium (He).

When a content of helium changes from 0% to 50% on condition that the discharge gas includes Ne, Xe and helium and a content of Xe is fixed to 15%, FIGS. 5A and 5B illustrate a consumption power and a luminance. In FIGS. 5A and 5B, Pb content in the barrier rib is equal to or less than 1,000 ppm.

Referring to FIG. 5A, when a helium content is 0%, a consumption power is about 275 W. When a helium content is 5%, a consumption power is about 273 W.

When the helium content ranges from 9% to 18%, a consumption power ranges from about 230 W to 265 W.

When the helium content ranges from 18% to 29%, a consumption power ranges from about 178 W to 230 W. When the helium content ranges from 29% to 42%, a consumption power ranges from about 1660 W to 178 W. When the helium content is equal to or more than 50%, a consumption power is about 164 W.

As illustrated in FIG. 5A, when the helium content ranges from 9% to 42%, the consumption power gradually decreases as the helium content increases. When the helium content is equal to or more than 50%, a decrease effect in the consumption power is small.

Referring to FIG. 5B, when the helium content is equal to or less than 9%, a luminance of a displayed image ranges from 137 cd/m$^2$ to 140 cd/m$^2$.

When the helium content ranges from 9% to 18%, a luminance of a displayed image ranges from 133 cd/m$^2$ to 137 cd/m$^2$.

When the helium content ranges from 18% to 29%, a luminance of a displayed image ranges from 129 cd/m$^2$ to 133 cd/m$^2$ and is sufficiently high. When the helium content ranges from 29% to 42%, a luminance of a displayed image ranges from 124 cd/m$^2$ to 129 cd/m$^2$.

When the helium content is equal to or more than 50%, a luminance of a displayed image is sharply reduced to about 112 cd/m$^2$.

As can be seen from FIGS. 5A and 5B, as the helium content increases based on total weight the discharge gas, the consumption power is improved but the luminance is reduced.

For instance, when the helium content is equal to or less than 10%, the luminance ranges from about 137 cd/m$^2$ to 140 cd/m$^2$ and is sufficiently high. However, the consumption power ranges from about 265 W to 275 W and is excessively high.

When the helium content is equal to or more than 50%, the consumption power is equal to or less than 164 W and is sufficiently low. However, the luminance is equal to or less than 112 cd/m$^2$ and is excessively low.

Accordingly, the helium content may range from 9% to 42% so as to maintain the consumption power at a low level and to increase the luminance. The helium content may range from 18% to 29%.

Since Xe increases the generation amount of vacuum ultraviolet rays inside the discharge cell, Xe can increase a luminance. Accordingly, a reduction in the luminance caused by helium can be compensated due to the control of a Xe content.

Figure 6A:
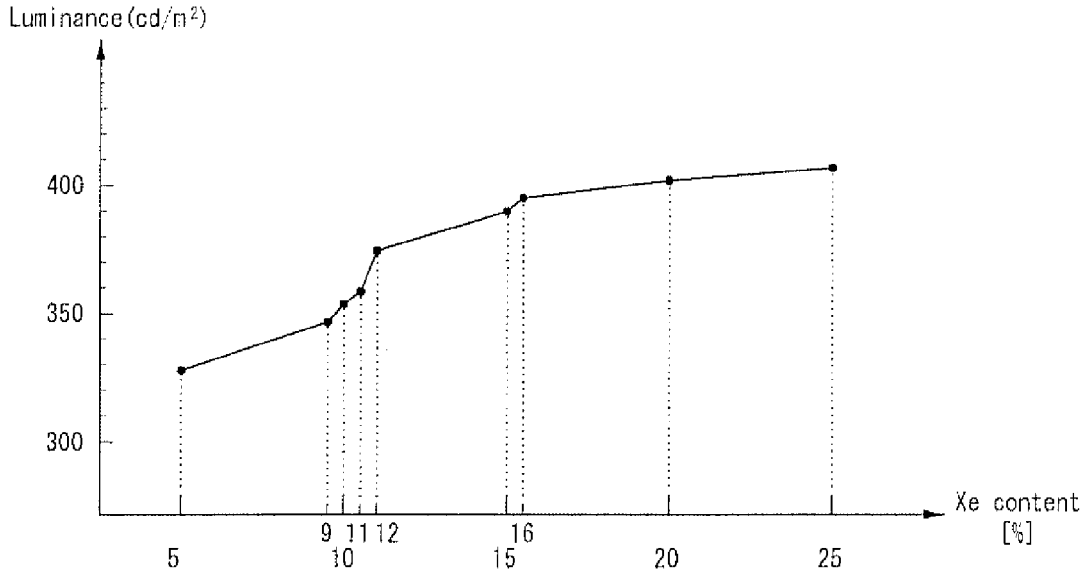
FIGS. 6A and 6B are graphs showing a luminance and a firing voltage depending on a content of xenon (Xe)
Figure 6B:
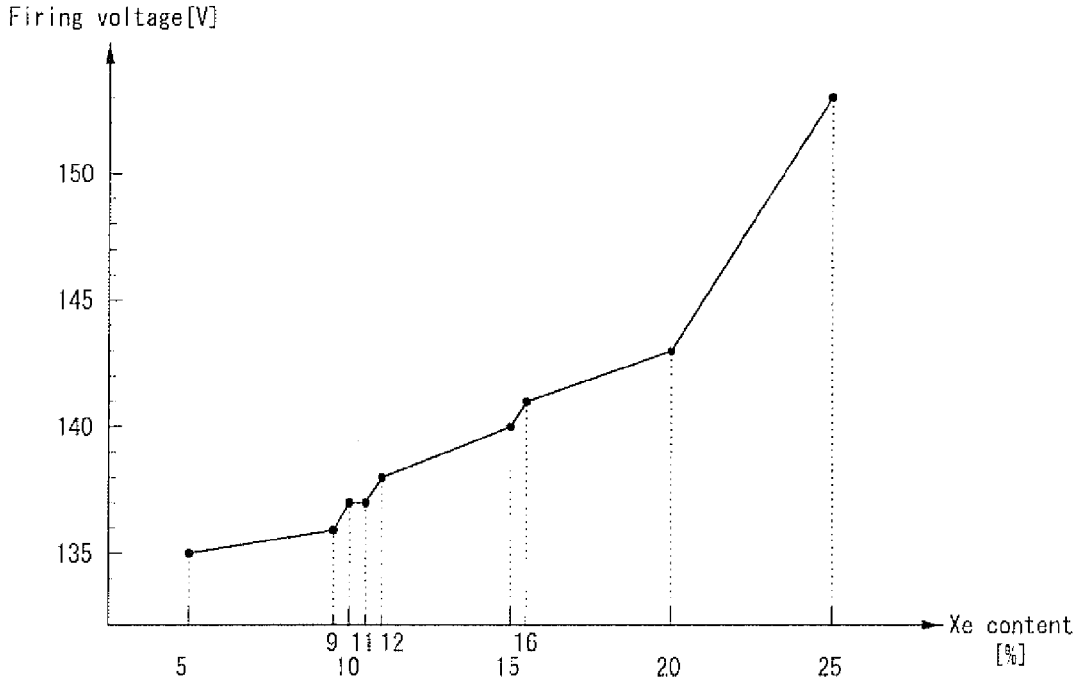

FIGS. 6A and 6B are graphs showing a luminance and a firing voltage depending on a content of xenon (Xe).

When a window pattern image of 25% is displayed on the screen on condition that a discharge gas includes Ne, He and Xe, a content of helium is fixed to 20% and a content of Xe changes from 5% to 25%, FIG. 6A is a graph showing a relationship between a luminance and a Xe content and FIG. 6B is a graph showing a relationship between a firing voltage between the scan and sustain electrodes and a Xe content.

Referring to FIG. 6A, when the Xe content is about 5%, a luminance of a displayed image is 329 cd/m$^2$. When the Xe content is about 9%, a luminance is 346 cd/m$^2$ and is relatively low.

When the Xe content is about 10%, a luminance increases to about 353 cd/m$^2$. Since Xe increases the generation amount of vacuum ultraviolet rays during the generation of a discharge, the quantity of light generated in the discharge cell increases due to an increase in the Xe content increases. Hence, the luminance increases.

When the Xe content is 11%, a luminance is about 359 cd/m$^2$. When the Xe content ranges from 12% to 15%, a luminance has a high value ranging from 373 cd/m$^2$ to 390 cd/m$^2$. When the Xe content is equal to or more than 16%, a luminance is about 396 cd/m$^2$.

As can be seen from FIG. 6A, when the Xe content increases from 10% to 20%, the luminance of the displayed image gradually increases. On the other hand, when the Xe content is equal to or more than 25%, an increase width in the luminance is small.

As illustrated in FIG. 6B, when the Xe content is about 5%, a firing voltage between the scan and sustain electrodes is about 135V. When the Xe content is about 9%, a firing voltage is about 136V. On the other hand, when the Xe content is about 10%, a firing voltage increases to about 137V.

Further, when the Xe content is about 11%, a firing voltage is about 137V. When the Xe content ranges from 12% to 15%, a firing voltage ranges from about 138V to 140V.

When the Xe content ranges from 16% to 20%, a firing voltage ranges from about 141V to 143V. When the Xe content is equal to or more than 25%, a firing voltage sharply increases to a value equal to or more about 153V.

As can be seen from FIG. 6B, even if the discharge gas includes helium, the luminance can increase due to the control of the Xe content. However, as the Xe content increases, the firing voltage between the scan and sustain electrodes rises.

Accordingly, the discharge gas includes Xe of 10 to 20% so as to maintain a luminance of a displayed image at a sufficiently high level and to prevent an excessive rise in a firing voltage between the scan and sustain electrodes in the structure in which the transparent electrode is omitted. The discharge gas may include Xe of 12 to 15%.

Figure 7A:
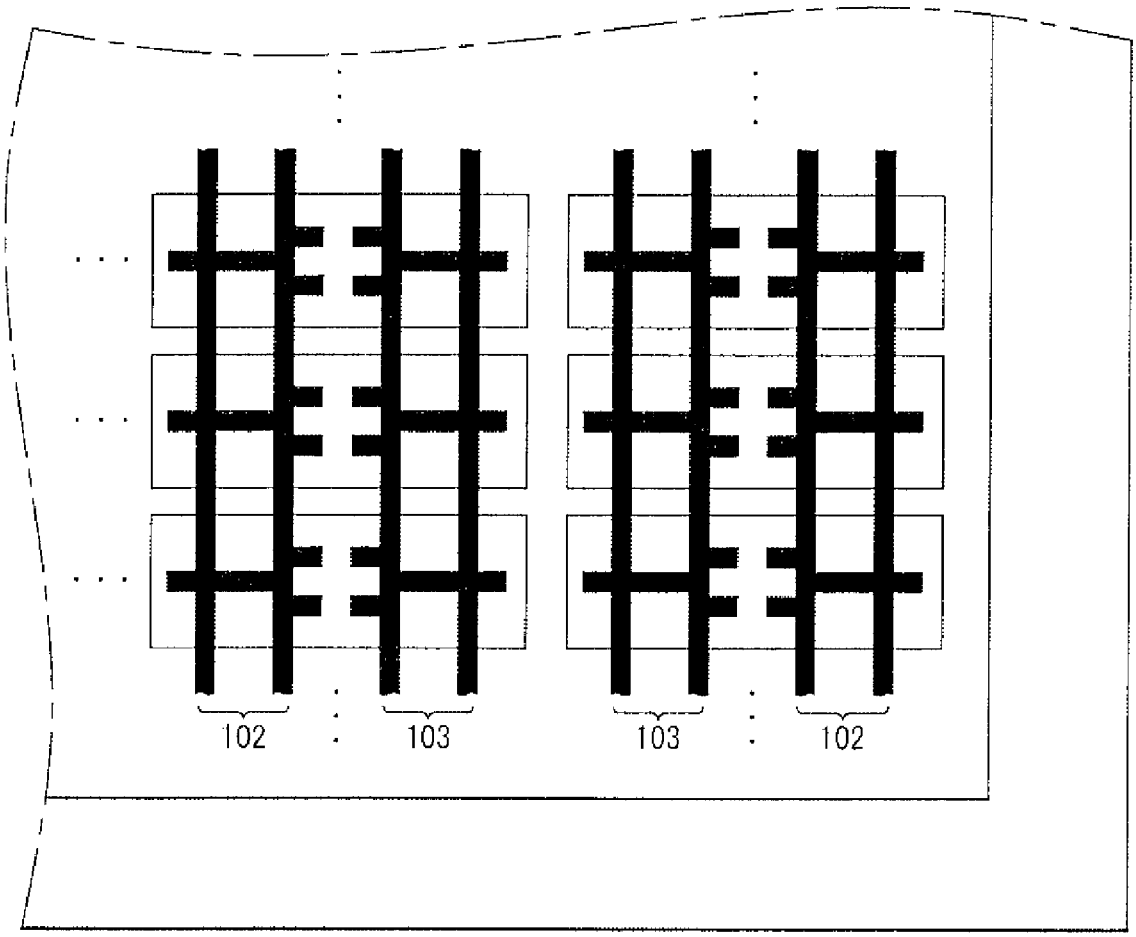
FIGS. 7A and 7B illustrate a scan electrode and a sustain electrode each having a single-layered structure.
Figure 7B:
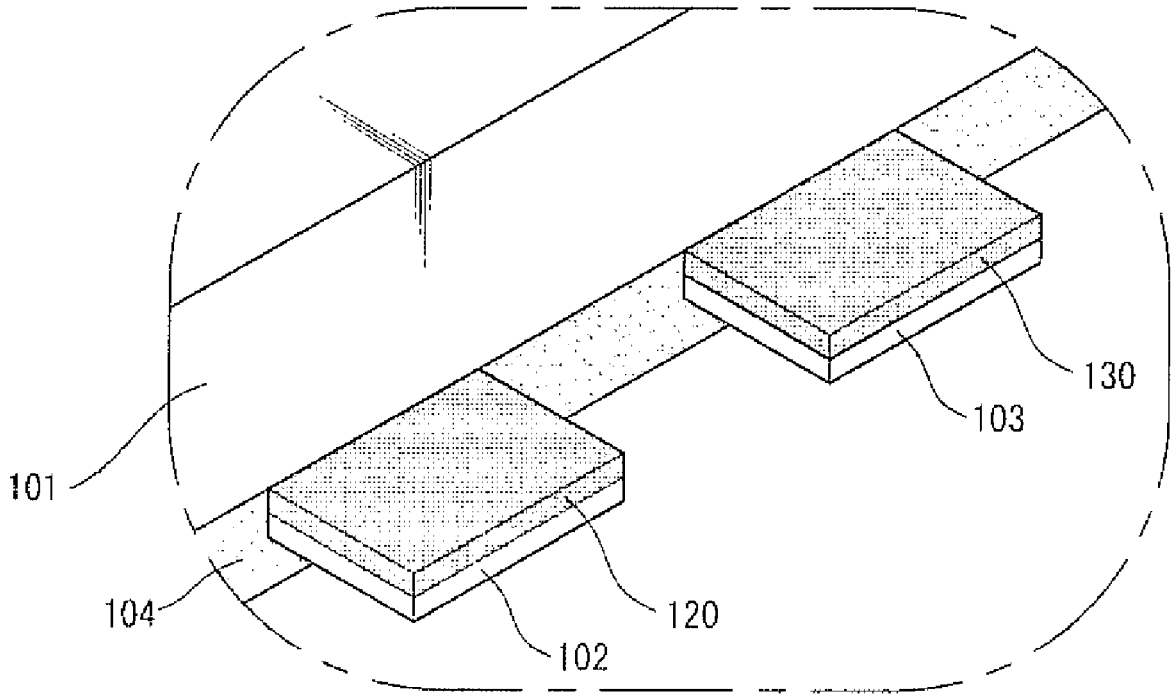

FIGS. 7A and 7B illustrate a scan electrode and a sustain electrode each having a single-layered structure.

As illustrated in FIGS. 7A and 7B, a scan electrode 102 and a sustain electrode 103 are positioned parallel to each other and have a single-layered structure.

Black layers 120 and 130 are positioned between the scan and sustain electrodes 102 and 103 and a front substrate 101.

The scan electrode 102 and the sustain electrode 103 may be formed of a metal material, which has excellent conductivity and is easy to mold, for instance, silver (Ag), gold (An), copper (Cu) and aluminum (Al).

The scan and sustain electrodes 102 and 103 having the single-layered structure may be called an ITO-less electrode in which a transparent electrode is omitted.

Figure 8A:
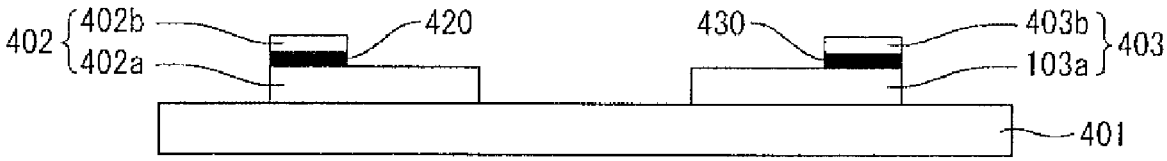
FIG. 8A illustrates a scan electrode and a sustain electrode each having a multi-layered structure.
Figure 8B:
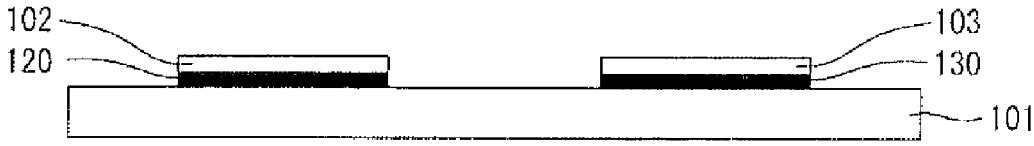
FIG. 8B illustrates a scan electrode and a sustain electrode each having a single-layered structure.

FIG. 8A illustrates a scan electrode 402 and a sustain electrode 403 each having a multi-layered structure, and FIG. 8B illustrates a scan electrode 102 and a sustain electrode 103 each having a single-layered structure.

In FIG. 8A, the scan electrode 402 and the sustain electrode 403 each include transparent electrodes 402*a* and 403*a* and bus electrodes 402*b* and 403*b*.

The bus electrodes 402*b* and 403*b* may include a substantially opaque material, for instance, at least one of Ag, Au, Cu or Al. The transparent electrodes 402*a* and 403*a* may include a substantially transparent material, for instance, indium-tin-oxide (ITO).

Black layers 402*a* and 403*a* are formed between the transparent electrodes 402*a* and 403*a* and the bus electrodes 402*b* and 403*b* to prevent the reflection of external light caused by the bus electrodes 402*b* and 403*b*.

A manufacturing method of the scan electrode 402 and the sustain electrode 403 of FIG. 8A is as follows. First, a transparent electrode layer is formed on a front substrate 401. Then, the transparent electrode layer is patterned to form the transparent electrodes 402*a* and 403*a*.

A bus electrode layer is formed on the transparent electrodes 402*a* and 403*a*. Then, the bus electrode layer is patterned to form the bus electrodes 402*b* and 403*b*.

On the other hand, the scan electrode 102 and the sustain electrode 103 of FIG. 8B is formed by forming an electrode layer on a front substrate 101 and patterning the electrode layer. In other words, since the manufacturing method of FIG. 8B is simpler than the manufacturing method of FIG. 8A, manufacturing time and the manufacturing cost in FIG. 8B are reduced.

In FIG. 8A, since the transparent electrodes 402*a* and 403*a* are formed of relatively expensive ITO, the transparent electrodes 402*a* and 403*a* provide a cause of a rise in the manufacturing cost.

In FIG. 8B, since relatively expensive ITO is not used, the manufacturing cost is reduced.

Figure 9A:
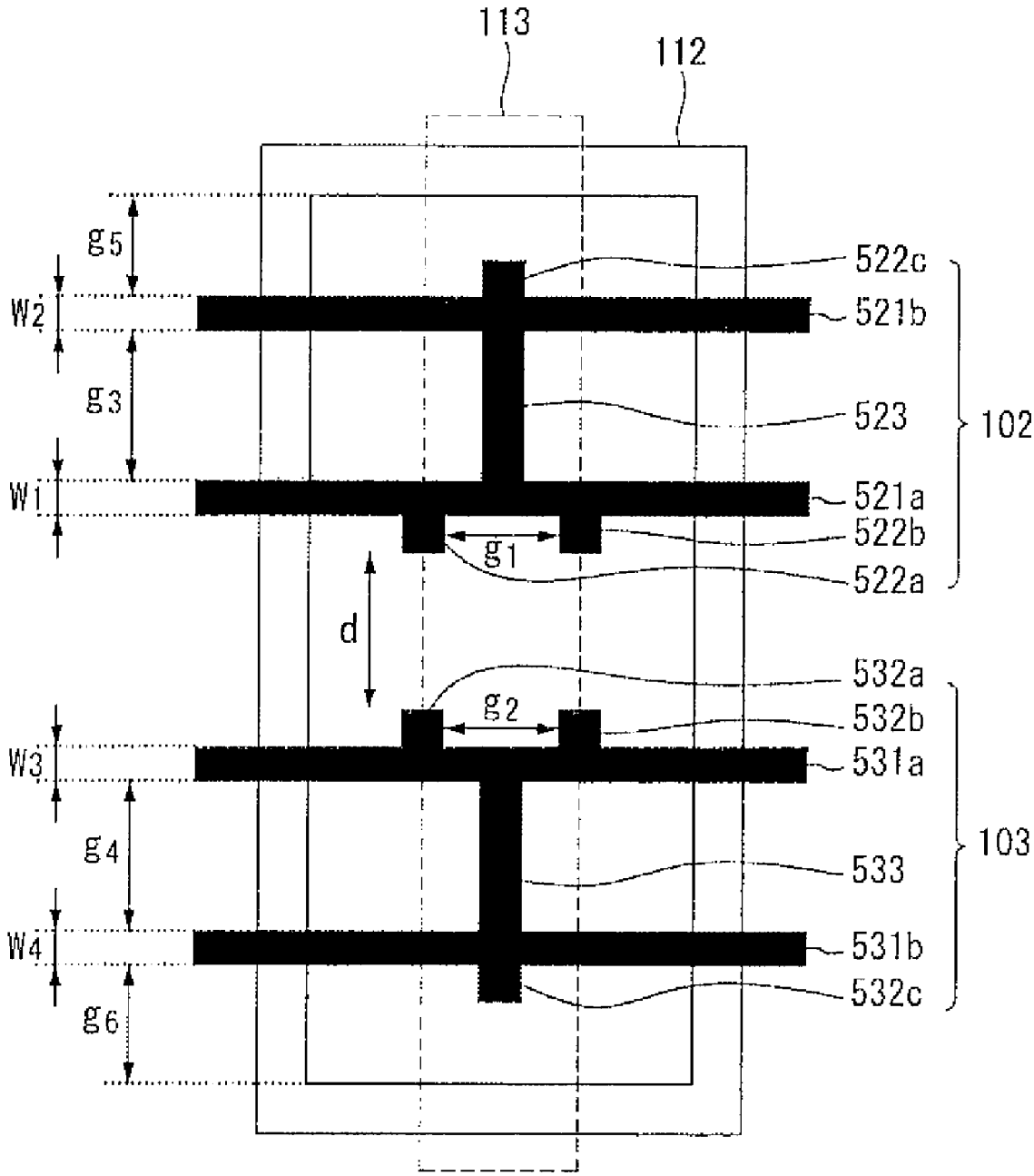
FIGS. 9A and 9B illustrate a structure of a scan electrode and a sustain electrode.
Figure 9B:
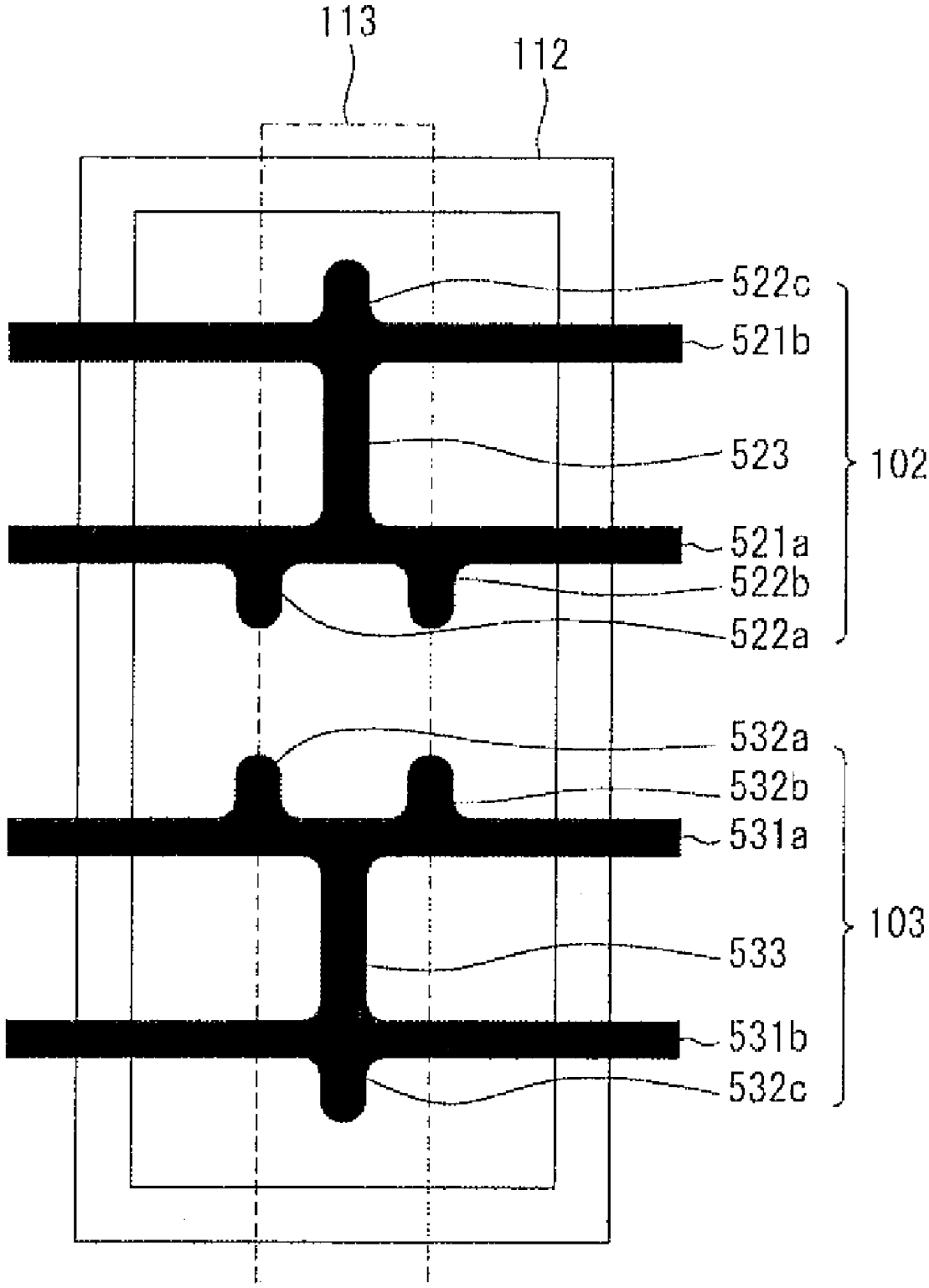

FIGS. 9A and 9B illustrates structure of a scan electrode and a sustain electrode.

As illustrated in FIG. 9A, the scan electrode 102 includes a plurality of line portions 521*a* and 521*b* intersecting the address electrode 113, and projecting portions 522*a*, 522*b* and 522*c* projecting from at least one of the line portions 521*a* and 521*b*. The sustain electrode 103 includes a plurality of line portions 531*a* and 531*b* intersecting the address electrode 113, and projecting portions 532*a*, 532*b* and 532*c* projecting from at the line portions 521*a*, 521*b*, 531*a* and 531*b*.

In FIG. 9A, the scan electrode 102 and the sustain electrode 103 each include three projecting portions. However, the number of projecting portions is not limited thereto. For instance, the projecting portions 522*c* and 532*c* may be omitted from the scan electrode 102 and the sustain electrode 103, respectively.

The line portions 521*a*, 521*b*, 531*a* and 531*b* have a predetermined width, respectively. For instance, the first and second line portions 521*a* and 521*b* of the scan electrode 102 have widths of W1 and W2, respectively. The first and second line portions 531*a* and 531*b* of the sustain electrode 103 have widths of W3 and W4, respectively.

The widths W1, W2, W3 and W4 may have a substantially equal value. At least one of the widths W1, W2, W3 or W4 may have a different value. For instance, the widths W1 and W3 may be about 35 μm, and the widths W2 and W4 may be about 45 μm larger than the widths W1 and W3.

When an interval g3 between the first and second line portions 521*a* and 521*b* of the scan electrode 102 and an interval g4 between the first and second line portions 531*a* and 531*b* of the sustain electrode 103 are excessively large, it is difficult to diffuse a discharge generated between the scan electrode 102 and the sustain electrode 103 into the second line portion 521*b* of the scan electrode 102 and the second line portion 531*b* of the sustain electrode 103. On the other hand, the intervals g3 and g4 are excessively small, it is difficult to diffuse the discharge into the rear of the discharge cell. Accordingly, the intervals g3 and g4 may ranges from about 170 μm to 210 μm, respectively.

To sufficiently diffuse the discharge generated between the scan electrode 102 and the sustain electrode 103 into the rear of the discharge cell, a shortest interval g5 between the second line portion 521*b* of the scan electrode 102 and the barrier rib 112 in a direction parallel to the address electrode 113 and a shortest interval g6 between the second line portion 531*b* of the sustain electrode 103 and the barrier rib 112 in a direction parallel to the address electrode 113 may ranges from about 120 μm to 150 μm, respectively.

At least one of the projecting portions 522*a*, 522*b*, 522*c*, 532*a*, 532*b* and 532*c* projects from the line portions 521*a*, 521*b*, 531*a* and 531*b* toward a central direction of the discharge cell. For instance, the projecting portions 522*a* and 522*b* of the scan electrode 102 project from the first line portion 521*a* toward the central direction of the discharge cell. The projecting portions 532*a* and 532*b* of the sustain electrode 103 project from the first line portion 531*a* toward the central direction of the discharge cell.

The projecting portions 522*a*, 522*b*, 522*c*, 532*a*, 532*b* and 532*c* are spaced apart from each other at a predetermined interval therebetween. For instance, the projecting portions 522*a* and 522*b* of the scan electrode 102 are spaced apart from each other at an interval of g1. The projecting portions 532*a* and 532*b* of the sustain electrode 103 are spaced apart from each other at an interval of g2. The intervals g1 and g2 may ranges from about 75 μm to 110 μm, respectively, so as to secure the discharge efficiency.

A length of at least one of the projecting portions 522*a*, 522*b*, 522*c*, 532*a*, 532*b* and 532*c* may be different from a length of the other projecting portions. Lengths of the projecting portions each having a different projecting direction may be different from each other. For instance, lengths of the projecting portions 522*a* and 522*b* may be different from a length of the projecting portion 522*c*, and lengths of the projecting portions 532*a* and 532*b* may be different from a length of the projecting portion 532*c*.

The scan electrode 102 and the sustain electrode 103 each include a connection portion for connecting at least two line portions. For instance, the scan electrode 102 includes a connection portion 523 for connecting the first and second line portions 521*a* and 521*b*, and the sustain electrode 103 includes a connection portion 533 for connecting the first and second line portions 531*a* and 531*b*.

A discharge starts to occur the between the projecting portions 522*a* and 522*b* projecting from the first line portion 521*a* of the scan electrode 102 and the projecting portions 532*a* and 532*b* projecting from the first line portion 531*a* of the sustain electrode 103.

The discharge is diffused into the first line portion 521*a* of the scan electrode 102 and the first line portion 531*a* of the sustain electrode 103, and then is diffused into the second line portion 521*b* of the scan electrode 102 and the second line portion 531*b* of the sustain electrode 103 through the connection portions 523 and 533.

The discharge diffused into the second line portions 521*b* and 531*b* is diffused into the rear of the discharge cell through the projecting portion 522*c* of the scan electrode 102 and the projecting portion 532*c* of the sustain electrode 103.

As illustrated in FIG. 9B, at least one of the projecting portions 521*a*, 521*b*, 521*c*, 531*a*, 531*b* and 531*c* may have a portion with the curvature. At least one of the projecting portions 521*a*, 521*b*, 521*c*, 531*a*, 531*b* and 531*c* may have an end portion with the curvature.

Further, a portion connecting the projecting portions 521*a*, 521*b*, 521*c*, 531*a*, 531*b* and 531*c* to the line portions 521*a*, 521*b*, 531*a* and 531*b* may have a curvature.

Further, a portion connecting the line portions 521*a*, 521*b*, 531*a* and 531*b* to the connection portions 523 and 533 may have a curvature.

As above, when the scan electrode 102 and the sustain electrode 103 each have the portion with the curvature, the scan electrode 102 and the sustain electrode 103 can be manufactured more easily. Further, the excessive accumulation of wall charges on a predetermined portion of the scan electrode 102 and the sustain electrode 103 can be prevented during a driving of the panel, and thus the panel can be stably driven.

Figure 10A:
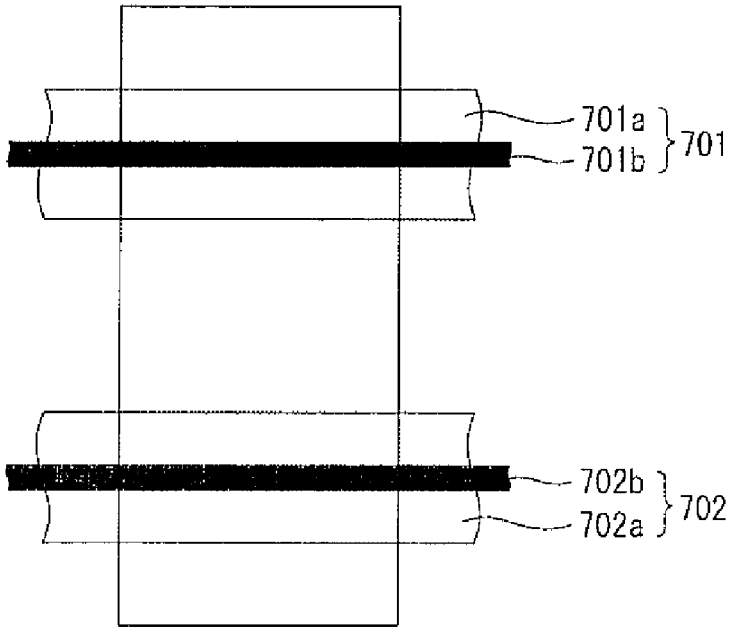
FIG. 10A illustrates a scan electrode and a sustain electrode each having a multi-layered structure.
Figure 10B:
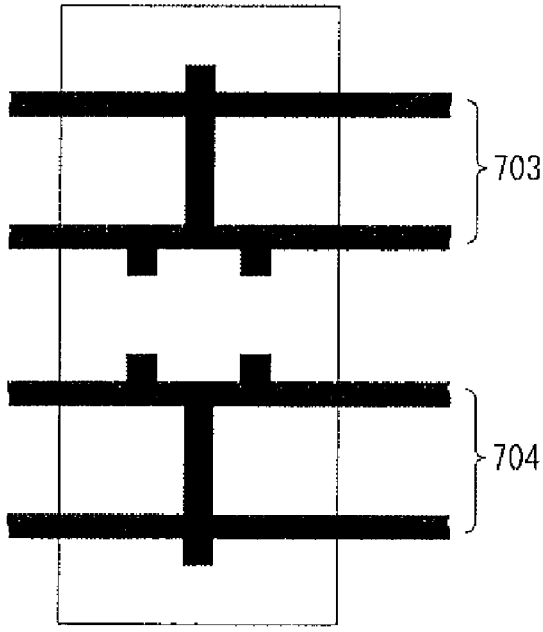
FIG. 10B illustrates a scan electrode and a sustain electrode each having a single-layered structure.

FIG. 10A illustrates a scan electrode 701 and a sustain electrode 702 each having a multi-layered structure in the same way as FIG. 8A, and FIG. 10B illustrates a scan electrode 703 and a sustain electrode 704 each having a single-layered structure in the same way as FIG. 8B.

In FIG. 10A, the scan electrode 701 and the sustain electrode 702 each include transparent electrodes 701*a* and 702*a* and bus electrodes 701*b* and 702*b*.

As above, because the scan electrode 701 and the sustain electrode 702 each include the transparent electrodes 701*a* and 702*a* in FIG. 10A, it does not matter that the entire area of the panel increases. On the other hand, because a transparent electrode is omitted in FIG. 10B, an excessive increase in areas of the scan electrode 703 and the sustain electrode 704 excessively reduces an aperture ratio of the panel and thus a luminance of a displayed image may be excessively reduced.

In other words, because the scan electrode 701 and the sustain electrode 702 each include the transparent electrodes 701*a* and 702*a* in FIG. 10A, areas of the scan electrode 701 and the sustain electrode 702 can increase by increasing areas of the transparent electrodes 701*a* and 702*a* in FIG. 10A. Hence, a driving voltage is reduced and thus the driving efficiency can be improved. Further, an aperture ratio of the panel is not reduced. On the other hand, when the areas of the scan electrode 703 and the sustain electrode 704 increase in FIG. 10B, a driving voltage is reduced but an aperture ratio of the panel is excessively reduced. Hence, a luminance of a displayed image may be excessively reduced.

Accordingly, since the areas of the scan electrode 703 and the sustain electrode 704 having the single-layered structure may be relatively small, a firing voltage between the scan electrode 703 and the sustain electrode 704 in FIG. 10B may be higher than a firing voltage in FIG. 10A.

However, when a discharge gas includes helium in FIG. 10B, helium acts as a catalyst for a discharge. Accordingly, helium can prevent an excessive rise in the firing voltage between the scan electrode 703 and the sustain electrode 704.

Accordingly, it is advantageous that the discharge gas includes helium in the plasma display panel in which the scan electrode and the sustain electrode each have the single-layered structure.

Figure 11:
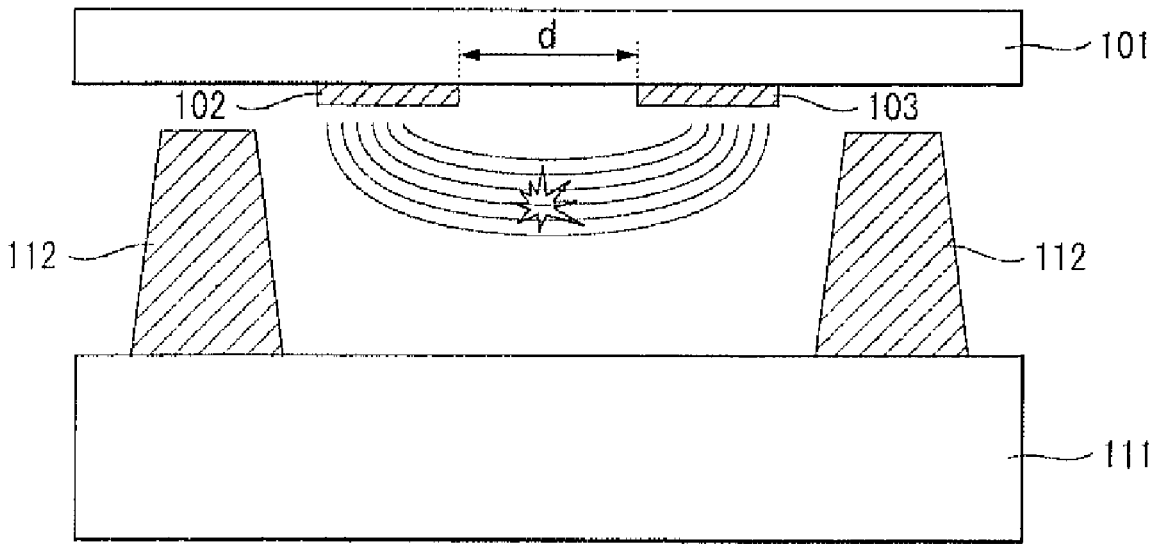
FIG. 11 is a diagram for explaining an interval between a scan electrode and a sustain electrode.

FIG. 11 is a diagram for explaining an interval between a scan electrode and a sustain electrode.

As illustrated in FIG. 11, the scan electrode 102 and the sustain electrode 103 are spaced apart from each other at an interval of d, and a discharge occurs between the scan electrode 102 and the sustain electrode 103.

When the interval d is sufficiently large, the quantity of light can increase because the discharge between the scan electrode 102 and the sustain electrode 103 sufficiently uses positive column. On the other hand, when the interval d is sufficiently large, a firing voltage between the scan electrode 102 and the sustain electrode 103 excessively rises.

In other words, as the interval d between the scan electrode 102 and the sustain electrode 103 increases, a luminance of a displayed image increases but the firing voltage between the scan electrode 102 and the sustain electrode 103 rises.

When the interval d is relatively large, the discharge between the scan electrode 102 and the sustain electrode 103 sufficiently uses positive column due to helium of the discharge gas. Accordingly, the luminance can be improved and helium can prevent an excessive rise in the firing voltage between the scan electrode 102 and the sustain electrode 103.

FIG. 12 is a graph showing a luminance and a firing voltage depending on an interval between a scan electrode and a sustain electrode.

FIG. 12 is a graph measuring a luminance of a displayed image and a firing voltage between the scan electrode and the sustain electrode when an interval between the scan electrode and the sustain electrode changes from 50 μm to 350 μm on condition that a discharge gas includes helium of 15.5% and Xe of 15%.

A sign ◎ indicates an excellent state (i.e., the luminance is very high or the firing voltage is sufficiently low). A sign ○ indicates a relatively good state. A sign X indicates a bad state (i.e., the luminance is very low or the firing voltage is excessively high).

When an interval d between the scan electrode and the sustain electrode ranges from 50 μm to 70 μm, it is difficult that a discharge between the scan electrode and the sustain electrode sufficiently uses positive column because the interval d is excessively small. Hence, the luminance is very low (i.e., a bad slate of X).

When the interval d ranges from 80 μm to 90 μm, the luminance is a good state of ○. In this case, because the interval d is relatively small, the luminance may be reduced. However, a reduction level in the luminance may be small.

When the interval d is equal to or more than 100 μm, a discharge between the scan electrode and the sustain electrode sufficiently use positive column because the interval d is sufficiently wide. Hence, the luminance is very high (i.e., an excellent slate of).

When the interval d ranges from 50 μm to 200 μm, the firing voltage is sufficiently low because the interval d is sufficiently small. Hence, the firing voltage is a excellent state of.

When the interval d ranges from 240 μm to 250 μm, the firing voltage is a relatively good state of ○.

When the interval d ranges from 310 μm to 350 μm, the firing voltage is excessively high because the interval d is excessively wide. Hence, the firing voltage is a bad slate of X.

As can be seen from FIG. 12, the interval between the scan electrode and the sustain electrode may range from 80 μm to 250 μm. Further, the interval may range from 100 μm to 200 μm.

As above, when the discharge gas includes helium, the efficiency and the consumption power are improved, but the luminance may be reduced.

A pressure of the discharge gas is adjusted to prevent a reduction in the luminance.

When the pressure of the discharge gas is relatively low, there is a small amount of particles in the discharge gas inside the discharge cell may be relatively small. Accordingly, the amount of ultraviolet rays emitted by the discharge gas during a discharge is relatively small, and thus the luminance may be reduced.

On the other hand, when the pressure of the discharge gas is relatively high, there is a relatively large amount of particles of the discharge gas inside the discharge cell. Accordingly, the amount of ultraviolet rays emitted by the discharge gas during a discharge increases, and thus the luminance may be improved.

A reduction in the luminance caused by helium can be compensated by setting the pressure of the discharge gas including helium to a relatively high value ranging from 400 torr to 500 torr.

The foregoing embodiments and advantages are merely exemplary and are not to be construed as limiting the present invention. The present Leaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate;

a scan electrode and a sustain electrode that are positioned parallel to each other on the front substrate;

an upper dielectric layer positioned on the scan electrode and the sustain electrode;

a rear substrate on which an address electrode is positioned to cross the scan electrode and the sustain electrode;

a lower dielectric layer positioned on the address electrode; and a barrier rib that is positioned between the front substrate and the rear substrate and partitions a discharge cell, the barrier rib including lead (Pb) equal to or less than 1,000 ppm (parts per million), wherein:

discharge gas is filled between the front substrate and the rear substrate and includes helium (He) of 9% to 42%, each of the scan electrode and the sustain electrode includes a plurality of line portions crossing the address electrode, at least one connection portion coupling at least two line portions of the plurality of line portions, and two or more projecting portions projecting from at least one of the plurality of line portions towards a center of the discharge cell from a top plan point of view of the discharge cell, the two or more projecting portions of the scan electrode are spaced from each other at a first interval, and the two or more projecting portions of the sustain electrode are spaced from each other at a second interval, at least one of the two or more projecting portions of the scan electrode and at least one of the two or more projecting portions of the sustain electrode are spaced from each other at a third interval, the first interval is substantially equal to the second interval, and the third interval is greater than the first interval or the second interval, wherein the address electrode includes a Pb content, the Pb content of the address electrode being equal to or less than 1,000 ppm, and wherein the Pb content lowers conductivity of the address electrode to achieve a corresponding reduction in capacitance.

2. The plasma display panel of claim 1, wherein the discharge gas includes helium of 18% to 29%.

3. The plasma display panel of claim 1, wherein the lower dielectric layer includes Pb equal to or less than 1,000 ppm.

4. The plasma display panel of claim 1, wherein the discharge gas includes xenon (Xe) of 10% to 20%.

5. The plasma display panel of claim 1, wherein the discharge gas includes Xe of 12% to 15%.

6. The plasma display panel of claim 1, wherein a pressure of the discharge gas ranges from 400 torr to 550 torr.

7. The plasma display panel of claim 1, wherein the first interval and the second interval lie within a range of about 75 μm to 110 μm.

8. A plasma display panel comprising:

a front substrate;

a scan electrode and a sustain electrode that are positioned parallel to each other on the front substrate, each of the scan electrode and the sustain electrode having a single-layered structure made from a material different from a transparent material;

an upper dielectric layer positioned on the scan electrode and the sustain electrode;

a rear substrate on which an address electrode is positioned to intersect the scan electrode and the sustain electrode;

a lower dielectric layer positioned on the address electrode; and a barmier rib that is positioned between the front substrate and the rear substrate and partitions a discharge cell, wherein each of the scan electrode and the sustain electrode includes a plurality of line portions crossing the address electrode, at least one connection portion coupling at least two line portions crossing the address electrode, at least one connection portion coupling at least two line portions of the plurality of line portions, and two or more projecting portions, projecting from at least one of the plurality of line portions towards a center of the discharge cell from a to plan point of view of the discharge cell, and the barrier rib including lead (Pb) equal to or less than 1,000 ppm, wherein a discharge gas is filled between the front substrate and the rear substrate and includes helium (He) of 9% to 42%, wherein the address electrode includes a Pb content, the Pb content of the address electrode being equal to or less than 1,000 ppm, and wherein the Pb content lowers conductivity, of the address electrode to achieve a corresponding reduction in capacitance.

9. The plasma display panel of claim 8, wherein the discharge gas includes helium of 18% to 29%.

10. The plasma display panel of claim 8, wherein the lower dielectric layer includes Pb equal to or less than 1,000 ppm.

11. The plasma display panel of claim 8, wherein the address electrode includes-Pb equal to or less than 1,000 ppm.

12. The plasma display panel of claim 8, wherein the discharge gas includes xenon (Xe) of 10% to 20%.

13. The plasma display panel of claim 8, wherein the discharge gas includes Xe of 12% to 15%.

14. The plasma display panel of claim 8, wherein a pressure of the discharge gas ranges from 400 torr to 550 torr.

15. A plasma display panel comprising:

a front substrate;

a scan electrode and a sustain electrode that are positioned parallel to each other on the front substrate;

an upper dielectric layer positioned on the scan electrode and the sustain electrode;

a rear substrate on which an address electrode is positioned to intersect the scan electrode and the sustain electrode;

a lower dielectric layer positioned on the address electrode; and a barrier rib that is positioned between the front substrate and the rear substrate and partitions a discharge cell, the barrier rib including lead equal to or less than 1,000 ppm, wherein a discharge gas is filled between the front substrate and the rear substrate and includes helium (He) of 9% to 42%, wherein each of the scan electrode and the sustain electrode includes a plurality of line portions crossing the address electrode, at least one connection portion coupling at least two line portions of the plurality of line portions, and at least one projecting portion projecting from one of the plurality of line portions toward a center of the discharge cell from a top plan point of view of the discharge cell, and wherein the at least one projecting portion includes an end portion and a base portion coupling the at least one projecting portion to said one of the line portions, the end portion and the base portion having predetermined curvatures, wherein the address electrode includes a Pb content, the Pb content of the address electrode being equal to or less than 1,000 ppm, and wherein the Pb content lowers conductivity of the address electrode to achieve a corresponding reduction in capacitance.

16. The plasma display panel of claim 15, wherein the scan electrode and the sustain electrode each have a single-layered structure.

17. The plasma display panel of claim 15, wherein the discharge gas includes helium of 18% to 29%.

18. The plasma display panel of claim 15, wherein an interval between the at least one projecting portion of the scan electrode and the at least one projecting portion of the sustain electrode ranges from 100 μm to 200μm.

19. The plasma display panel of claim 15, wherein at least one portion, where the at least one connection portion is linked to one of the line portions, has a predetermined curvature.

* * * * *